United States Patent [19]

Leich

[11] 4,228,724

[45] Oct. 21, 1980

[54] AMMUNITION LOADER

[76] Inventor: Robert A. Leich, 4208 Chimney Pointe Dr., Bloomfield Hills, Mich. 48013

[21] Appl. No.: 42,758

[22] Filed: May 29, 1979

[51] Int. Cl.[3] ..... F42B 33/02

[52] U.S. Cl. ..... 86/26; 86/23; 86/25; 86/32

[58] Field of Search ..... 86/23, 25, 26, 32

[56] References Cited

U.S. PATENT DOCUMENTS

| | | | |
|---|---|---|---|
| 2,091,397 | 8/1937 | Shockey | 86/23 |
| 2,325,642 | 8/1943 | Turnock et al. | 86/23 |

*Primary Examiner*—Leland A. Sebastian
*Attorney, Agent, or Firm*—Krass & Young

[57] ABSTRACT

A press type ammunition loader in which the casings are sequentially advanced through a series of work stations by means of a shuttle bar which is reciprocated along the line of the work stations and also moved laterally into and out of engagement with the casing series. A simplified shuttle bar operating arrangement is disclosed including a cam actuated hitch-index shuttle cooperating with other shuttle bar operating components operated by reciprocal movement of lower and upper platen plates which also operate the respective loader components at each work station. The shuttle bar advance and return movement is executed while engaged with C-form springs, maintaining an inward bias force. The upper and lower platens are reciprocated by rotation of a crank-link assembly, which also operates a primer feed slide mechanism, by means of a cable and pulley drive moving a primer slide bar between primer pick up and seating positions. The primer feed slide mechanism provides a dwell in both positions of the slide bar with the feed slider being released by the cable to advance under spring force against an adjustable stop, and thence retracted against a second adjustable stop with a lost motion providing the pick up position dwell of the primer slide bar in either position for reliable primer feed and seating location. The cable drive system allows release of the drive between the crank and the slide bar to enable raising of the upper platen without corresponding movement of the primer slide to enable ready clearing of jammed conditions.

25 Claims, 12 Drawing Figures

AMMUNITION LOADER

BACKGROUND DISCUSSION

Ammunition for modern firearms is generally loaded in either specialized high volume machinery such as for commercial or military production, or alternatively by low volume hand operated presses. The latter of these is commonly sold for reloading of the shell casings by sportsmen, since the cost of the shell casings represents a proportionately great fraction of the cost of ammunition, allowing ammunition to be reloaded at a fraction of the cost of the purchase from manufacturers. Such hand presses are adapted to relatively low volume production inasmuch as all of the steps in the reloading process require individual manual handling of the shell casings into the various die sets for loading of the components necessary to carry out the reloading.

For many situations, such as police departments and private shooting ranges, there is expended a high volume of ammunition and hand reloading of the shell casings is not practical.

The present inventor has heretofore invented press type ammunition loading apparatus, in which the shell casings are automatically fed and transferred through a series of work stations, in which die sets each simultaneously perform a step in the loading process by reciprocal motion of upper and lower platens. A much greater volume of production can be achieved by relatively simple and low cost equipment highly suited to medium volume production. These inventions are described and claimed in U.S. Pat. Nos. 3,580,128; 3,678,799; and 3,714,860.

This equipment, while being vastly cheaper and simpler than commercial or military production equipment, is still substantially more costly than the presently available hand loading equipment, putting the cost of such equipment out of the reach of small volume users.

The devices described in the above-mentioned patents call for a motorized drive of the upper and lower platens, which motion performs the various loading functions as well as to operate a shuttle bar mechanism which is relied on to advance the shell casings through the various work stations. Such components are relatively costly and if hand operation of the device, as well as a simplification of the various components, could be achieved, the cost of the apparatus could be significantly reduced.

One of the components in the reloading apparatus disclosed in the above-mentioned patents is the primer feed mechanism, which executes precision location of a feed slide bar in both of two operative positions. In the pick up position, the slide bar is adapted to receive a primer fed from a supply tube into a pocket formed in the slide bar. After pick up, primer feed slide is advanced to a position in which the pocket is disposed over the work station whereat the primer is seated in the primer pocket of the casing disposed in the work station. Both positions require a high degree of accuracy in order to insure proper feeding of the primer into the slide bar pocket and to insure proper location of the primer with respect to the primer pocket of the shell casing and the need for such precision requires relatively costly components.

Another problem encountered with respect to primer feed is clearing of a jammed condition. If a jam develops at the primer seating station due to an attempt to seat a primer in the shell casing in which the fired primer has not been removed for some reason, the slide bar will tend to jam. Since the primer seating occurs with the upper platen in the descended position, it is difficult to obtain access clearance for clearing the jammed condition, due to the positive drive connection of the feed slide mechanism with the platen drive mechanism in the arrangement described in these patents.

Accordingly, it would be convenient if the feed slide drive could be easily and quickly disconnected from the remainder of the mechanism to allow the upper platen to be conveniently withdrawn with the feed slide bar still in position.

Accordingly, it is an object of the present invention to provide an ammunition loader of the general type described in the above-referenced patents in which the shuttle bar drive arrangement is simplified and reduced in cost.

It is another object of the present invention to provide a drive mechanism for the loader press which is simple but reliable in operation.

It is a further object of the present invention to provide a feed slider mechanism having the ability to be accurately positioned in either of a forward or retracted position, corresponding to the primer pick up and primer seating positions without necessitating precision components.

It is still a further object of the present invention to provide such a primer feed slide arrangement which allows immediate disconnection of the drive to the primer feed slide, such that the loader press mechanism can be cycled leaving the primer slide in the forward or primer seating location, enabling the convenient clearing of a jammed condition.

SUMMARY OF THE INVENTION

These and other objects of the present invention, which will become apparent upon a reading of the following specification and claims, are provided by an ammunition loader having a drive mechanism consisting of a simple crank assembly rotatably supported on a pair of pillow block plates, which in turn support the lower platen, and a pair of links extending upwardly through slots in the lower platen plate and pivotally connected to the upper platen plates, such as to produce corresponding reciprocation of the upper platen with oscillation of the crank assembly, which in turn may be manually operated by a lever joined to the crank assembly.

The advance of the casing train through these stations is by means of a notched shuttle bar, as in the above-mentioned patents, which shuttle bar is reciprocated and moved laterally into and out of engagement with the casings in order to carry out the sequential advance of the casings through a line of work stations whereat are located the various dies and other components for carrying out the loading process. The shuttle bar operating mechanism according to the present invention features simplified components, including a hitch-index mechanism consisting of an oscillating index shuttle channel mounted to the lower platen and engaged by a roller cam carried by the upper platen, and causing pivoting indexing movement of the index shuttle channel against a bias of a return spring. The index shuttle channel has a finger disposed within a corresponding movement of the shuttle bar, or to generate a return position bias force acting thereon by the return spring.

The shuttle bar is mounted for in and out lateral movement induced by cam wedge operated slide bars engaging the interior side surface of the shuttle bar, and prior to return movement of the shuttle bar, forcing the shuttle bar out laterally against the bias of a pair of springs, each consisting of narrow strips of spring steel formed into C-shaped sections. Bearing strips brazed to the one side of each C-form are mounted to be in contact with the outer edge of the shuttle bar to exert a spring force urging the shuttle bar back into its in position, and acting throughout the return movement of the transfer bar induced by the hitch-index mechanism, and the interaction of the slide bars and a bronze wedging dog. This latter component cooperates with the other shuttle bar operating components to produce synchronized movements of the shuttle bar as well as precisely locating the bar in the forward operative position.

The primer slide feed mechanism consists of a primer feed drive block to which is affixed the primer feed slide bar, in turn guided in a slot formed in the lower platen during reciprocating movement from a retracted, primer pick up position to an advanced, primer seating position. Reciprocation is carried out by a cable drive operated by the crank rotation, acting to allow an operating spring to move the primer block forward into the advanced position. An adjustable stop positions the slider block and primer slide bar in the advanced position, with the cable drive enabling a forward position dwell after contact with the stop and continued rotation of the crank assembly.

In moving to the pick up position, the cable drive pulls the slider block against the bias of the operating spring into engagement with a pick up position adjustable stop, whereat the primers are fed into a pocket in the primer slide bar.

A dwell is provided in this position by a second spring disposed within an opening in the slider block which is compressed by further retraction of the cable to provide the necessary lost motion. The cable is tensioned by a tensioning spring which enables the cable to be quickly removed from an idler pulley, to disable the driving connection between the crank and the slide block, enabling reciprocation of the upper and lower platens without corresponding movement of the primer slide bar to facilitate clearance of a jammed condition at the primer seating work station.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed isasmuch as the invention is capable of taking many forms and variations within the scope of the appended claims.

Figure 1:
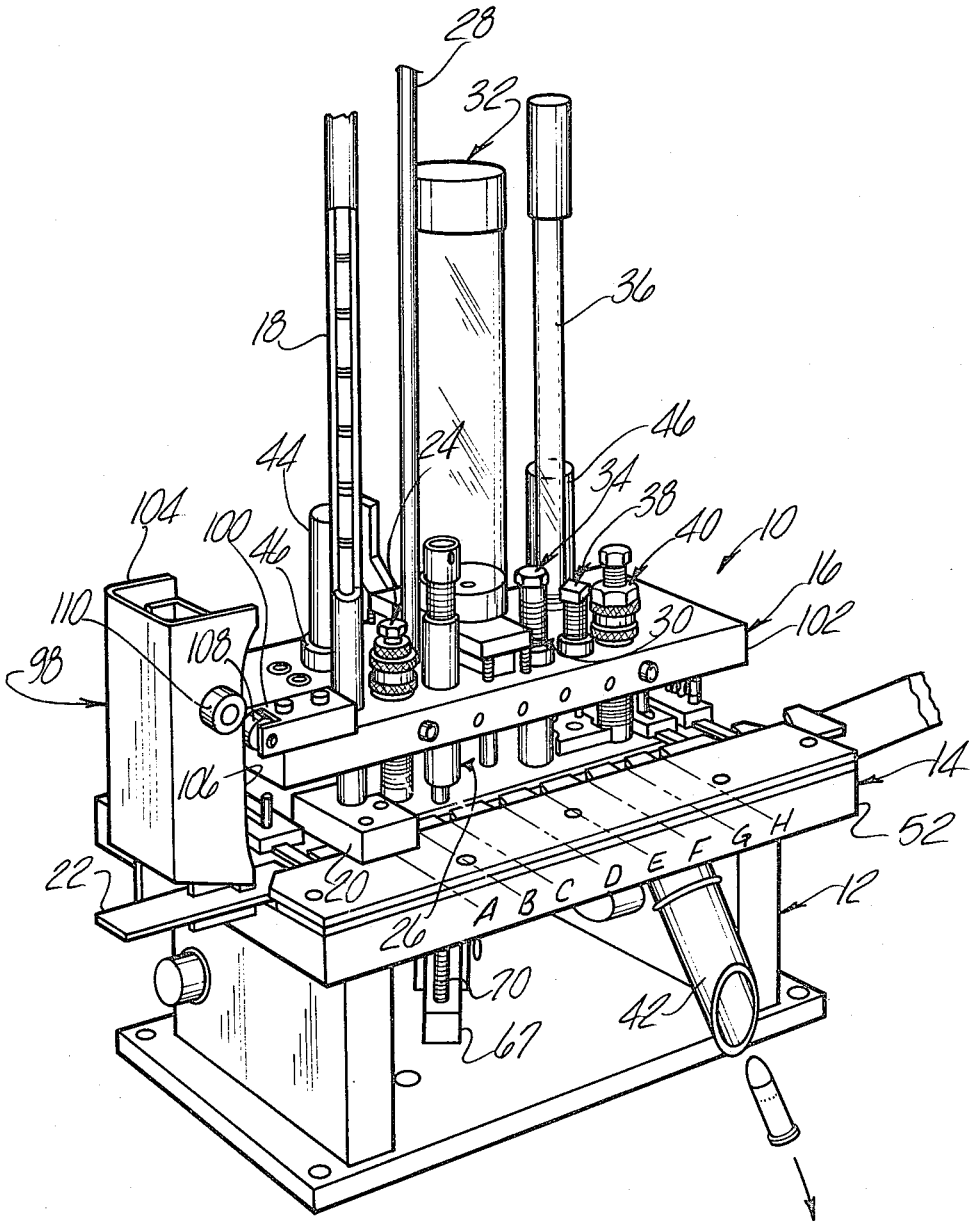
FIG. 1 is a front perspective view of the ammunition loader according to the present invention.

Referring to FIG. 1, the ammunition loader 10 according to the present invention consists of a base assembly 12, a lower platen assembly 14 and an upper platen assembly 16. The base assembly 12 provides a support for the lower platen 14 and upper platen 16 and also mounts the operating mechanism for producing reciprocation of the upper platen 16 towards the lower platen 14.

Lower platen 14 provides the mounting surface for a shuttle transfer mechanism, for transfer of a series of shell casings through a line of work stations, whereat each of the steps in the loading process are carried out.

The upper platen assembly 16 provides a mounting for the various die sets and component supply tubes and feed mechanism located at linearly spaced points in alignment with the corresponding work station positions of the lower platen 14. The various die sets and feed mechanisms are operated by the reciprocation of the upper platen assembly 16 relative the lower platen assembly 14. The shuttle bar operating mechanism is likewise operated by this motion, as will be described in further detail hereinafter.

The particular die sets and feed supply tubes pictured in FIG. 1 are appropriate for reloading of expended hand gun shell casings, although the principles of design of the loader 10 are, of course, applicable to other ammunition types and sizes, such as rifle and shotgun ammunition.

Such die sets and feed supply tubes are per se well known to those skilled in the art and are described in the above-referenced patents and a detailed description of the same will not be here included. However, for the purposes of completeness, the ammunition loader 10 depicted in FIG. 1 includes a case entry station "A" whereat casing are fed from a casing entry tube 18 into a casing entry guide 20 which correctly positions the casings in the shuttle bar 22 which is notched to accept the shell casings as will be described hereinafter in detail.

The shuttle bar 22 advances the casing to station "B" whereat the casing is deprimed as well as resized by a resizing-depriming die set indicated generally at 24. The casing is thence advanced to station "C" whereat the primers are seated in the primer pockets of the casing by a primer seating die 26. The primers are fed into position for this step from a primer supply tube 28 and by a primer feed slide mechanism forming a part of the present invention.

The primed casing is advanced to station "D" whereat powder charge is deposited in the interior of the shell casing by a powder metering mechanism 30 which received powder from a powder supply tube 32.

Thence, the casing is advanced to station "E" whereat an expander beller die set 34 causes belling expansion of the mouth of the casing in order that it will accept the bullet to be seated therein.

Each casing is then successively advanced to station "F" where the bullets are seated, received from bullet supply tube 36 and feed mechanism, positioning a bullet beneath a seating die set 38, which forces the bullet into the mouth of the shell casing.

In station "G", a crimping die set 40 is located which serves to crimp the bullet such that it may be securely retained within the shell casing.

Finally, the casing is advanced to station "H" consisting simply of an appropriately located opening in lower platen assembly 14, communicating with an exit chute 42.

Figure 2:
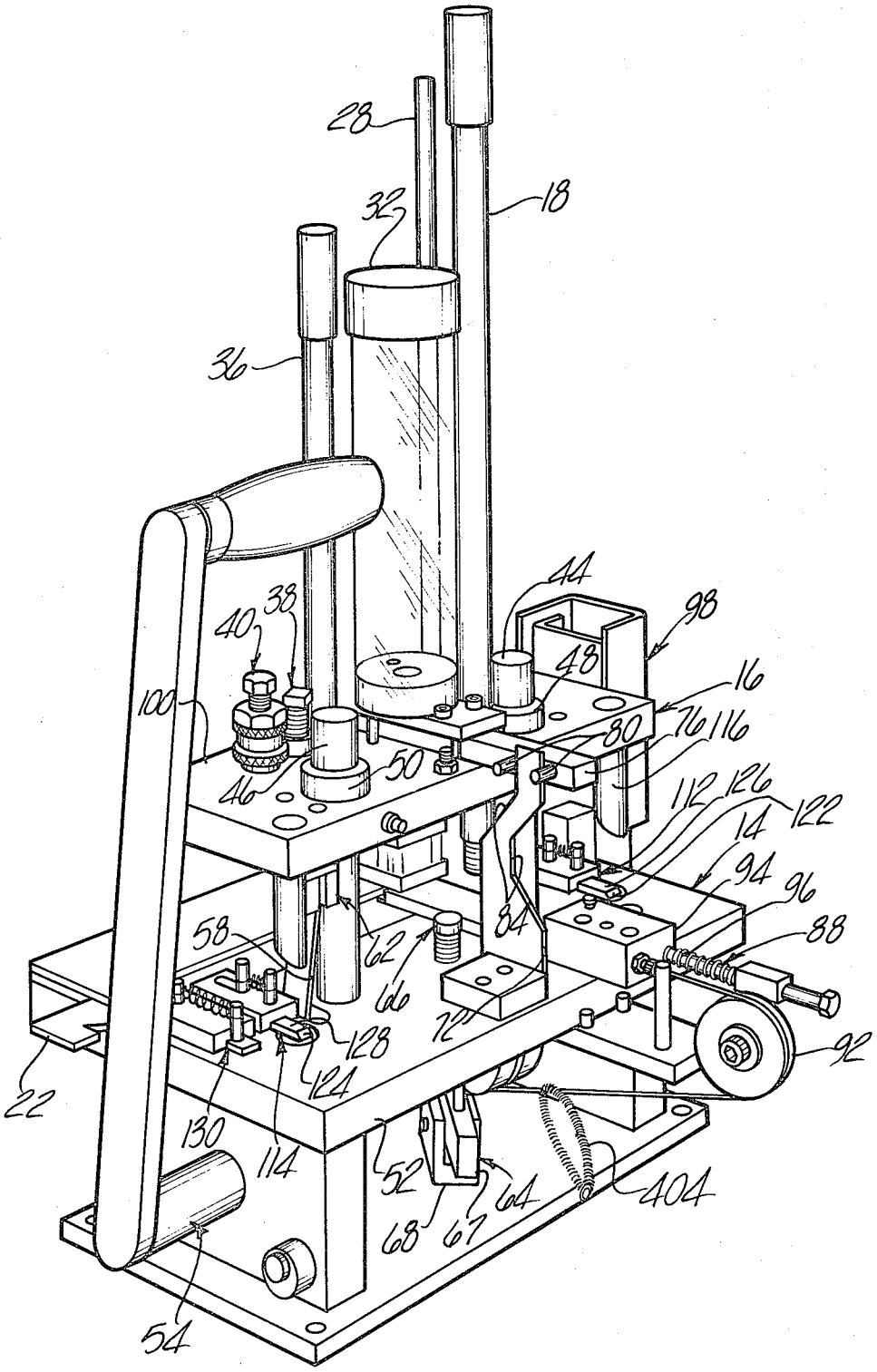
FIG. 2 is a rear elevational view of the ammunition loader depicted in FIG. 1 with certain components omitted for the sake of clarity.

Upper platen assembly 16 is guided during its movement with respect to the lower platen assembly 14 on a pair of guide pins 44 and 46 extending normally with respect to the upper platen assembly 16 and lower platen assembly 14 seated in bushings 48 and 50 (FIG. 2). The guide pins 44 and 46 are pressed into the lower platen plate 52.

The various reloading components, including the shuttle bar operating mechanism, for transfer of the casings successively through the work stations "A" through "H", the various dies and the associated feed mechanisms for the powder supply tube 32 and bullet supply tube 36 are operated by the vertical reciprocation of the upper platen assembly 16.

The only exception is the primer feed slide mechanism, associated with the primer feed tube 28 which is instead operated directly by a crank assembly driving the upper platen assembly 16, as will be described hereinafter in detail.

Reciprocation of the upper platen assembly 16 on the guide pins 44 and 46 is induced by oscillation of handle-crank assembly 54, manual manipulation of which causes the upper platen assembly 16 to descend towards lower platen assembly 14 and thence return upwardly to its initial start position. This motion is induced by a pair of crank links 56 and 58 pinned to link support blocks 60 and 62 mounted to the upper platen assembly 16.

The descending motion of the upper platen assembly 16 directly operates the die sets 34, 38 and 40 in conventional fashion. The primer die set 26 is operated by a primer seating mechanism 64 positioned beneath the lower platen assembly 14 in turn operated by means of a spring plunger 66 (FIG. 2) causing rocking motion of a primer pivot 67 in a pivot clevis 68. This rocking motion operates a spring biased primer seating pin assembly 70 with the upper half of the primer seating die set 26 securing the casing in position during the seating step.

The powder feed slider mechanism and the bullet feed tube 36 respectively, are operated by vertically extending cam plates 72 and 74 associated with the powder charge slide bar 76 and bullet slide bar 78 are not depicted in FIG. 2 in order to reveal other details of the ammunition loader 10 in this view.

Each of the vertical cam plates 72 and 74 induces sliding in and out movement of the respective slide bars 76 and 78 by being trapped between pin pairs 80 and 82 extending from the powder and bullet slide bars 76 and 78. This results in a constrained movement in direct correspondence with the contour of vertically extending side surfaces 84 and 86 on the respective vertical cam plates 72 and 74 as the upper platen assembly 16 decends towards the lower platen assembly 14 and is reelevated to its initial position.

This in and out movement casues a powder charge and a bullet to be fed respectively from the powder supply tube 32 and the bullet supply tube 36, and moved into position at the corresponding work stations, for discharge of the powder into the casing, and seating of the bullet by the die set 38.

The primer feed slide mechanism indicated generally at 88 as noted, is not operated by the reciprocating motion of the upper platen assembly 16, but rather is operated directly by the crank-handle assembly 54 which causes windup of a cable 90 which passes around an idler pulley 92 to exert a pull of the primer slide block 94. This pulling motion acts against an operating spring 96 tending to urge the slide block 94 into an advanced position such that the cable 90 during pulling motion casuse movement of the primer slide block 94 to the pick up position, whereat a primer is picked up from the primer feed tube 28. Upon releasing extension of the cable 90, the operating spring 96 induces forward motion of the primer slide block 94 into the work station, whereat the primer is positioned for seating in the casing primer pocket.

Further details of this mechanism will be described hereinafter inasmuch as this mechanism forms an important aspect of the present invention.

The shuttle bar operating arrangement is operated entirely by the vertical reciprocal motion of the upper platen assembly 16, which arrangement includes a hitch-index mechanism 98 mounted to the lower platen plate 52 and engaged by a cam roller assembly 100 carried by the upper platen 102. Hitch-index mechanism includes a shuttle index channel 104 having a linearly extending cam contour 106 formed thereon, engaged by a cam roller 108, to cause the shuttle index channel 104 to assume various positions about a pivotal mounting 110, in correspondence with position of the upper platen assembly 16. This causes advancing and retracting motion of the shuttle bar 22, as will be described in detail, and at the same time, the shuttle bar 22 is caused to move in and out laterally with respect to the work stations to allow movement into and out of engagement of the linear array of casings constituted by a casing positioned in each of the work stations.

This in and out movement is caused by a pair of pusher bar assemblies 112 and 114 positioned at either end thereof so as to engage the inside edge at either end of the shuttle bar 22. These assemblies are operated by means of the descending motion of the upper platen assembly 16 by a pair of cam wedges 116 and 118 secured to the upper platen plate 102 and coming into engagement with wedge surfaces 120 and 122 on pusher bars 126 and 128, respectively, at an appropriate point in the press cycle.

The hitch-index mechanism cooperates with a dog mechanism 130 to control and time the hitch-index mechanism 98. Details of the operation of this mechanism also will be described further hereinafter.

Figure 3:
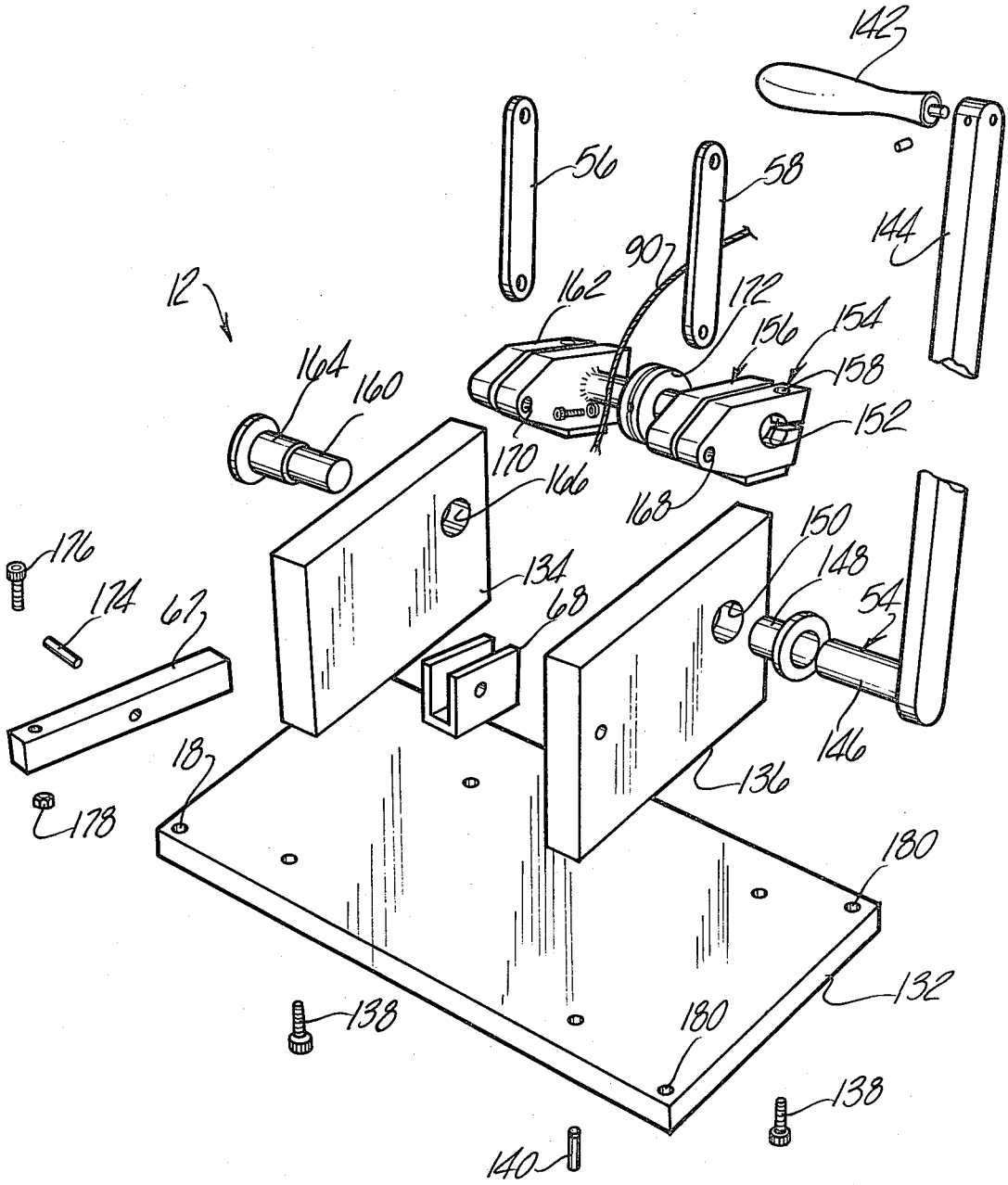
FIG. 3 is an exploded perspective view of the crank and base assembly components of the ammunition loader depicted in FIGS. 1 and 2.
Figure 4:
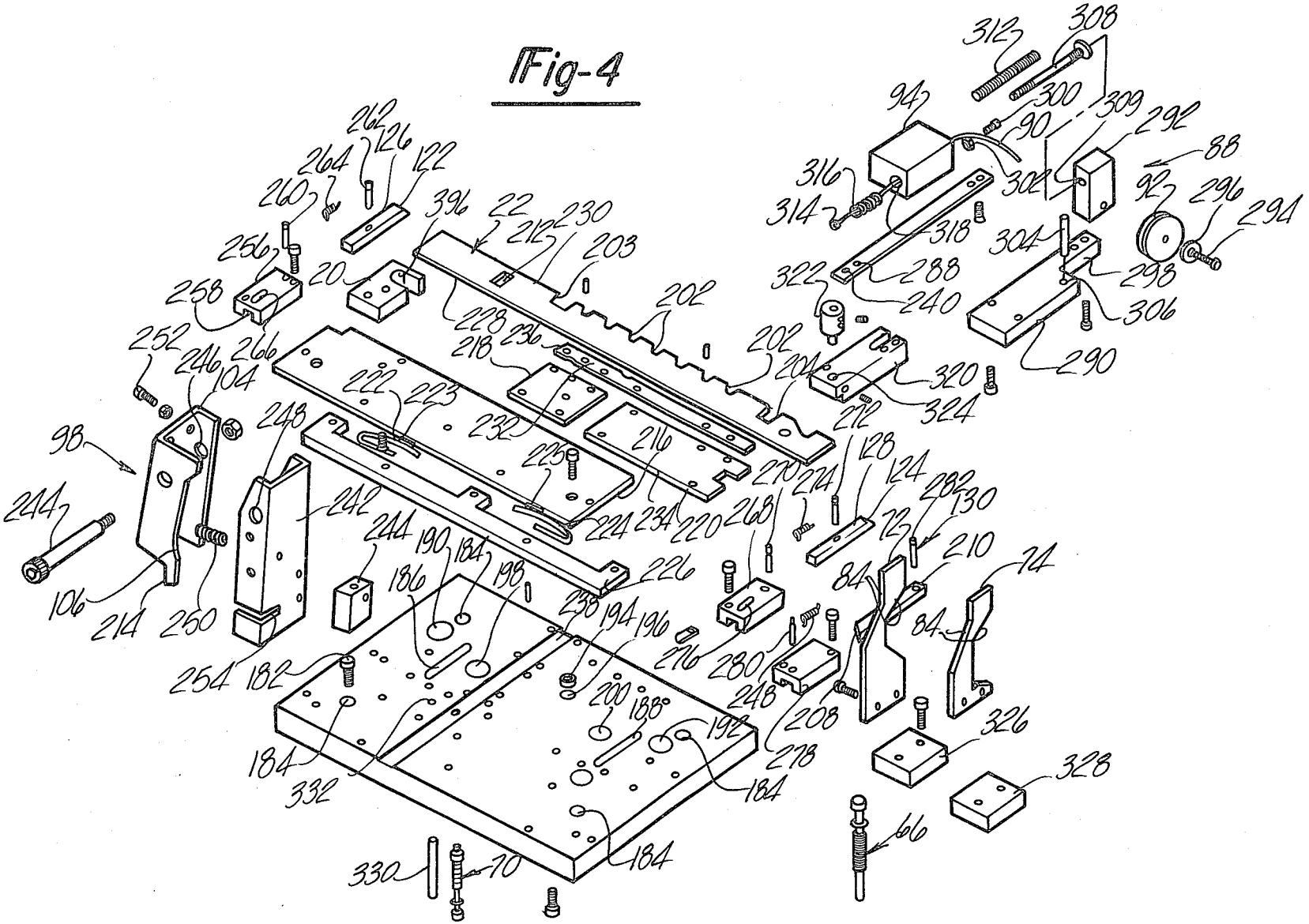
FIG. 4 is an exploded perspective view of the lower platen assembly of the ammunition loader depicted in FIGS. 1 and 2.
Figure 5:
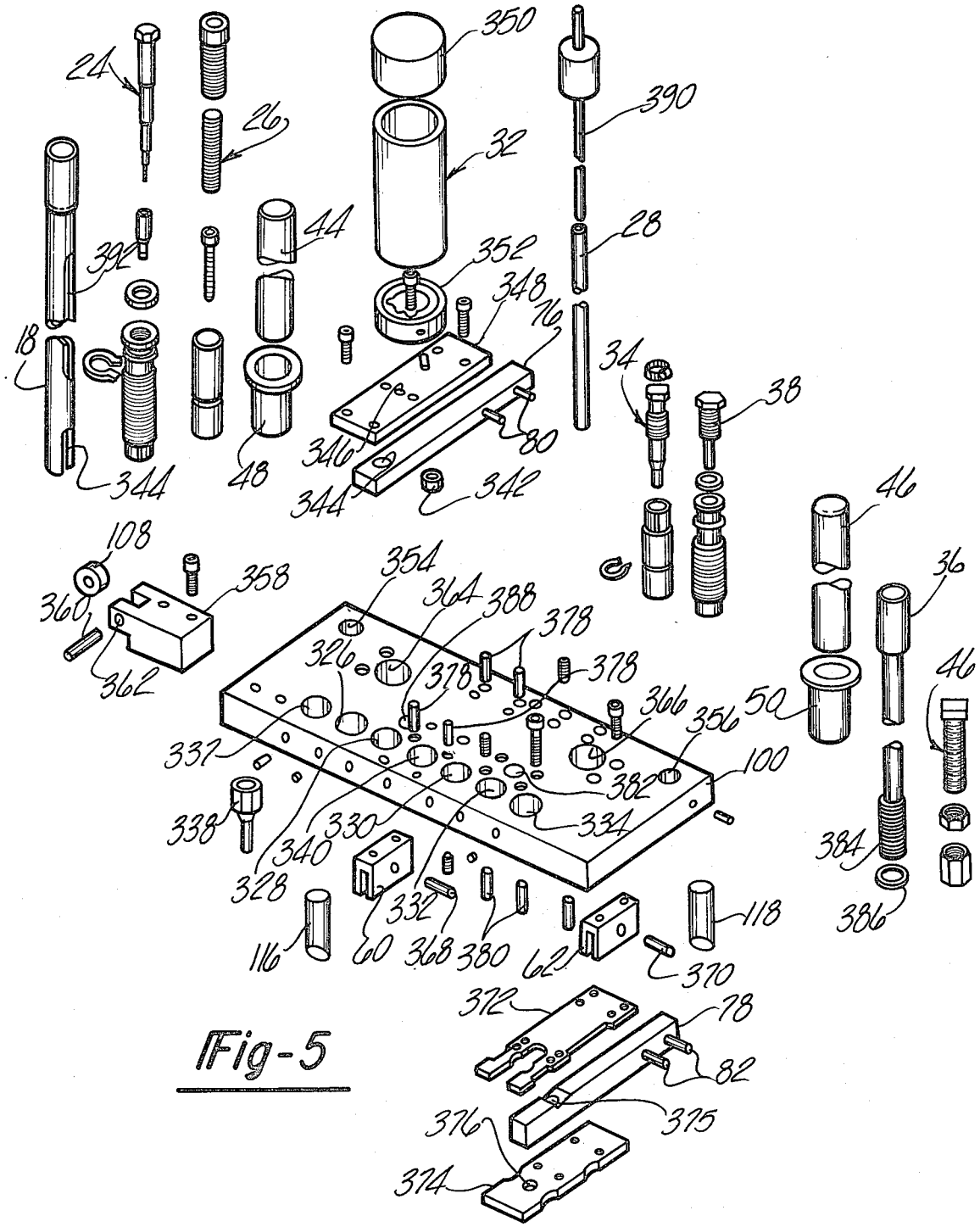
FIG. 5 is an exploded perspective view of the upper platen assembly components incorporated in the ammunition loader of FIGS. 1 and 2.

Reference is now made to FIGS. 3 through 5, each depicting exploded perspective views of the base and lower and upper platen assemblies respectively.

The base assembly includes a base plate 132 to which is secured a pair of pillow block plates 134 and 136 in spaced apart relation by means of cap screws 138 and dowels 140, such as to be in an upstanding parallel position on the upper surface of base plate 132. The pillow block plates 134 and 136 provide a pivotal support for the handle-crank assembly plate 54. The handle-crank assembly 54 includes a handle 142 secured to a handle lever 144, the handle lever 144 having secured to it a pivot shaft 146 slidably received within bushing 148 in turn received within a corresponding opening 150 in the side of pillow block plate 136.

The protruding end of the pivot shaft 146 extends through the bushing 148 and is received within a sleeve opening 152 formed in a crank throw 154 carried in turn by a crank throw assembly 156. A fastener is received in a threaded opening 158 passing through the split end to clamp the end of the pivot shaft 146 to provide a secure connection.

The opposite end of the crank throw assembly 156 is pivotally supported on the pillow block plate 134 by being received in a pivot shaft 160 and clamped to a corresponding crank throw 162 secured thereto in similar fashion. Pivot shaft 160 is received in a corresponding bushing 164, in turn mounted within opening 166 in the pillow block plate 134.

To each of the crank throws 154 and 162 are pivotably mounted respective links 56 and 58 by pins passing through openings 168 and 170, respectively. The pivot points 168 and 170 are offcenter from the axis of rotation of the crank throw assembly 156 produced by manipulation of the handle 142, such that corresponding up and down movement of the links are induced thereby.

In the down position, the pivot holes 168 and 170 are positioned substantially horizontally spaced from the axis of rotation of the crank assembly 156 such that upon counterclockwise motion of the handle lever 144 towards the front of the ammunition loader 10, the links 56 and 58 are drawn downward to produce the corresponding downward motion of the upper platen assembly 16.

Intermediate the crank throws 156 and 162, is a collar 172 to which is adapted to be secured the cable 90 such that upon rotation of the crank assembly 156 the cable 90 is either wound up or unwound therefrom to produce the corresponding motion of the primer slide block 94.

The only operating component located below the lower platen assembly 14 is the primer seating mechanism including the pivot clevis 68 which is mounted to the upper surface of the base plate 132 and the pivot bar 67 pivotally mounted within the clevis 68 by means of a cross pin 174. A cap screw 176 is secured to a nut 178 provided at the outboard end of the pivot bar 67 to contact the primer seating assembly 70.

Mounting holes 180 are provided at the four corners of the base plate 132 to enable ready mounting of the ammunition loader 10 to a tabletop or other working surface.

Referring to FIG. 4, the various components mounted to the lower platen assembly 14 are depicted, and include the lower platen plate 52 which is mounted to the pillow block plates 134 and 136 by cap screws 182 passing through countersunk openings 184. A pair of elongated slots 186 are provided at spaced locations corresponding to the location of the pivot links 56 and 58 which accommodate the oscillating movement thereof during the rotation of the crank arm handle assembly 54 in the raising and lowering of the upper platen assembly 16.

Bores 190 and 192 are provided within which are secured the guide posts 44 and 46, respectively.

The spring plunger 66 is disposed within a bushing 194 secured in an opening 196 extending into the upper surface through the lower platen plate 52.

A pair of openings 198 and 200 are also provided which provide clearance for the cam wedge pins 116 and 118, respectively, to accommodate the downward movement as they engage the wedge surfaces 122 and 124 of the respective pusher bars 126 and 128. These surfaces are positioned directly over the openings 198 and 200, respectively, to achieve this end.

The shuttle bar 22 is mounted for sliding movement on the upper surface of the lower platen plate 52 both side to side and in and out in order to advance the casings through the series of work stations.

The shuttle bar 22 is provided with a series of notches 202 formed into the inside edge and configured to have slots 202 each corresponding to one of the stations "A" through "H" with the eight stations being accounted for by the forward and reverse or side to side motion of the shuttle bar 22. Thus, with advancing motion of the shuttle bar 22 there are seven shell casings in the series which are simultaneously advanced.

The shuttle bar 22 is also formed with rectangular notches 204 which cooperate with the pusher bar assemblies 112 and 114 and dog wedge 130 as will be described hereinafter.

An additional notch 206 is provided having a sloping side contour extending toward the opposite end to cooperate with the leading edge 208 of the wedge 210 included in the dog wedge assembly 130.

A central rectangular opening 212 is provided which receives finger 214 extending from the shuttle index channel 104 such that the oscillatory pivoting movement thereof results in forces or motion being transmitted into the shuttle bar 22.

The motion of the shuttle bar 22 is confined beneath a cover plate 216 and atop a pair of wear plates 218 and 220, between the lateral front edge 232 of back bar 236 and a pair of spring forms 222 and 224 mounted in pockets formed in a spacer plate 226. The cover plate 216 is mounted atop the spacer plate 226, which in turn is mounted on the leading edge of the lower platen plate 52. The cover plate 216 protrudes over the rear edges of the spacer plate 226 such as to provide an overhang passing over the top surface of the shuttle bar 22 to contain the same.

As noted, the front surface 228 of the shuttle bar 22 is in bearing contact with the spaced spring forms 222 and 224 while the rear edge 230 slides during forward motion against the frontal edge 232 of the back bar 236 and is in abutment therewith when the shuttle bar 22 is in position in engagement with the shell casings. The back bar 236 mounted to the surface of the lower platen plate 52 in spaced position from the spacer plate 226 to accommodate the in and out movement of the shuttle bar 22 undergone during a transfer cycle.

The wear plates 218 and 220 are in spaced relation with a top bar 236 bridging the same over a guide groove 238 machined into the upper surface of the lower platen plate 52. This accommodates the primer slide bar 240 guided and located in its side-to-side motion by the position of the wear plates 218 and 220 with the groove 238 providing clearance, but with the actual contact of the sides of the primer slide bar 240 being with respect to the side surfaces of wear plates 218 and 220. These plates are adjusted at assembly to provide precise location in the side to side position of the slide bar 240 with respect to an opening 241 machined through the lower platen plate 52 and through which the primer seating pin assembly 70 passes in carrying out the primer seating step.

Thus, the shuttle bar 22 is controlled and confined beneath the cover plate 216 but is able to move in and out with respect to the edge 232 against the bias of the springs 222 and 224.

The shuttle bar 22 undergoes a side to side, i.e., advance and return movement during the transfer motion and also an in and out movement in which it is moved in and out of engagement with the casings prior to the advance and return movement respectively. The shuttle bar 22 is normally positioned in its position preparatory to the initiation of another transfer forward motion.

Spring wire forms 222 and 224 accommodate the return sliding movement while the shuttle bar is in the out position, while exerting the bias spring force on the shuttle bar 22.

The advance and return movement is induced by the hitch-index mechanism indicated generally at 98, including the hitch-index channel 104 which is pivotally mounted to an index support channel 242 fixed to the lower platen plate 52 by means of a mounting block 244 secured to the upper surface thereof and in turn secured to the index support channel 242.

The hitch-index shuttle channel 104 is pivotally mounted on the index support channel 242 by means of a pivot pin 245 passing through openings 246 in the index shuttle channel 104 and corresponding openings 248 in the index support channel 242.

A return spring 250 is provided which biases the hitch index shuttle channel 104 in the counterclockwise direction as viewed in FIG. 4 tending to urge the shuttle bar 22 to the return position by virtue of engagement of the finger 214 with the opening 212 in the shuttle bar 22.

Cam contour 106 engages the cam roller 108 which produces a corresponding motion of the hitch index shuttle channel 104 to the vertical motion of the upper platen assembly 16.

A stop screw 252 limits the counterclockwise motion of the hitch index channel 104 about the pivot pin 244, while a notch 254 provides a clearance for the shuttle bar 22 to pass through the support channel 242.

The push bar 126 is mounted within mounting blocks 256 which have internal mounting channels 256 having a slot 258 within which the pusher bar 126 is adapted to be slidably received. A pair of pins are mounted respectively to the slide channel 256 and the pusher bar 126, the pins 262 protruding through a slot 266 formed in the slide channel 256 such that the spring 264 urges the pusher bar 126 to a retracted position within the slot 258.

This is also the case with respect to the mounting channel 268 slidably receiving a pusher bar 128 with pins 270 and 272 being provided with a spring 274 secured at either end to the respective pins. The pin 270 is mounted to the block slider channel 268, pin 272 mounted to the slider bar 128 passing through the channel 276 such as to urge the block into the return position as indicated in FIG. 2.

The wedge dog 210 is slidably mounted in a mounting channel 278 with pins mounted in the slide channel 278 and a pin 282 mounted in the end of the wedge dog 210 to the forward position.

The primer feed slide mechanism 88 components depicted in FIG. 4 include the previously mentioned primer feed slide bar 240 which has a pocket 288 mounted therein which is sized to receive a primer picked up from primer feed tube 28. The primer feed slide bar 240 is affixed to the primer feed slide block 94.

The primer roller bracket 290 is mounted to the underside of the lower platen plate 52 and mounted thereon is the primer roller bracket block 292, on which the idler pulley roller 92 is rotatably supported by means of threaded pin 294 and washer 296 received in the primer roller block 292. A notched out area 298 provides clearance for the idler roller 92.

The primer slider block 94 carries an adjustable stop screw 300 is received within a threaded bore within the slider block 94 and adjusting nut 302 provides securement of the stop screw 300 is any given adjusted position. The stop screw 300 is in alignment with a stop pin 304 received within an opening 306 on one side of the primer roller bracket 290 to thus provide an adjustable stop for retracting movement of the primer slide block 94.

To provide a stop for the forward position, there is included an adjusting bolt 308, received within a threaded bore within the slider block 94, with a set screw 310 provided to secure the adjustment bolt 308 in any given adjusted position. An operating spring 312 is concentrically positioned about the adjusting bolt 308 and tends to urge the primer slider block 94 to the end position by being seated against the front face of the primer roller block 292 through which the adjusting bolt 308 passes. The full forward position is controlled by the adjusted position of bolt 308 seating on the back face of the primer roller block 292.

Cable 90 passes into the interior of the slider block 94 and is provided at one end with a washer 314 which acts to compress a spring block 94, to allow for dwell in the retracted position as will be further described hereinafter with reference to the succeeding views.

Located over the retracted or pick up position is a primer channel 320, which receives a primer feed bushing 322 in an opening 324 and which in turn serves to receive the primer feed tube 28.

The cam plates 72 and 74 are mounted to the lower platen plate 52 by means of cam support blocks 325 and 327, repectively, mounted to the lower platen plate 52, having the respective cam plates 72 and 74 mounted to the lateral surfaces thereof.

A primer exit tube 329 is also provided mounted in the primer exit hole 331 formed extending through the lower platen plate 52, and which receives the fired primers removed from the casings in station "A".

Referring to FIG. 5, the various components of the upper platen assembly 16 are depicted consisting primarily of the die set and feed mechanism components. These include the deprimer die assembly 24, the primer seating die 26, a beller die set 34, the bullet seating die 38 and the bullet crimping die set 40. Each of the respective die sets are mounted in a linear array of openings formed in the upper platen plate 102 in a corresponding position to the respective work stations: the deprimer and sizer die 24 mounted in the opening 326; the priming dies set 26 in opening 328; the belling die mounted in opening 330; the bullet seating die mounted in opening 332; and, the crimping die 40 mounted in opening 334.

The casing feed tube 18 is seated in the opening 336 while the powder charging die 338 is mounted in opening 340, positioned beneath and at the full in position of the powder charge slide bar 76 previously mentioned.

The powder bushing 342 is mounted in opening 344 in the powder charge slide bar 76 which is adapted to receive the charge of powder through central opening 346 in a powder spacer plate 348 upon which is mounted the powder supply tube assembly 32 including the cover 350. The powder tube support 352 is mounted on the top surface of powder spacer plate 348. The reciprocal movement of powder charge slider block 76 thus enables filling the interior of the powder bushing 342 and thence dumping of the powder through the powder spacer plate 348 into the interior of the casing.

The cam wedges 116 and 118 are pressed in openings 354 and 356 in the upper platen plate 102. The side pins 44 and 46 similarly are received in bores 364 and 366 respectively.

Cam roller 108 is mounted in a support block 358 with a roller pin 360 passing into clevis opening 362 in the support block 358 in turn mounted to the upper surface of the upper plated plate 102.

The link mounting blocks 60 and 62 are mounted to the undersurface of the upper platen plate 102 with cross pins 368 and 370 utilized to provide the pivotal connection with the upper end of each of the links 56 and 58.

The bullet slide 78 is mounted between bullet spacer plate 72 and a bullet plate 374 having an opening 376 in which the bullet passes and serving to locate the same with respect to the shell casing in position directly beneath the opening.

The powder charge slider block 76 and the bullet slide 78 are constrained in their sliding motion by being confined between spaced dowel sets (378 and 380 respectively) received in openings in the upper platen plate 102 and respectively into the powder tube spacer plate 348 and bullet spacer plate 372.

The bullet slide 78 is formed with an opening 375 into which the bullet passes from the bullet supply tube 36.

The bullet supply tube 36 is mounted in an opening 382 in the upper platen plate 102 with a threaded portion 384 cooperating with a lock washer 386.

The primer feed tube 28 is mounted in a similar opening 388 freely passing therethrough and mounted in the primer feed bushing 322.

A weight and pusher rod 390 is provided to produce downward biasing force for reliable feeding of the primer from within the interior of the supply tube 28.

The casing supply tube 36 is provided with a frontal slot 392 to provide viewing of the interior to determine the number of casings contained therein. A frontal slot 394 is provided in order to enable the casing to move out from the casing index plate 20, front slot 396, correctly aligning the casings with the shuttle bar.

Referring to FIGS. 6A through 6D, certain details of the shuttle bar 22 mounting are depicted in which the various positions of the shuttle bar 22 and related components during the transfer motion cycling are shown.

The side-to-side or forward and return motions of shuttle bar 22 are induced by the action of the cam roller 108 in engagement with the cam contour 106 on the hitch index shuttle channel 104, as the upper platen assembly 16 is reciprocated with respect to the lower platen assembly 14 during an operational cycle of the ammunition loader 10. The advancing motion of the shuttle bar 22, i.e., to the right as viewed in FIGS. 6A through 6D, is positive due to the direct action of the cam roller 100 and the cam surface 106 forcing the shuttle bar 22 to the right into the advanced position shown in FIG. 6A.

The return motion of the shuttle bar 22 is induced by the return spring 250. A controlled return movement is created by the action of the dog wedge mechanism 130 and the urging of the return spring 250 as well as the cam contour 106.

Figure 6A:
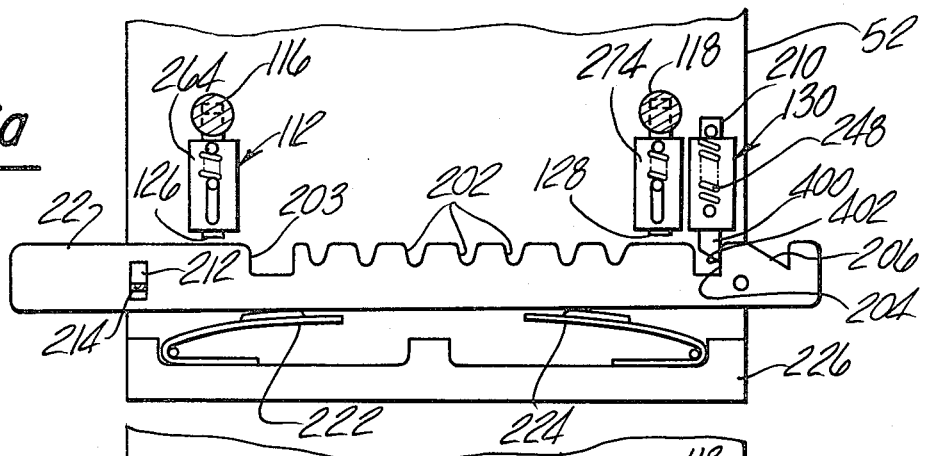
FIGS. 6A through 6D are plan views of the shuttle bar and certain related components in various operating positions assumed during the course of an operational cycle of the ammunition loader depicted in FIGS. 1 and 2.

As the upper platen assembly 16 approaches the operational portion of the downstroke, i.e., to the point whereat the various dies perform their operation on the shell casing, the shuttle bar 22 is advanced to its full advanced position until the cam wedge 210 enters the notch 204 as indicated in FIG. 6A.

The cam contour 106 is configured to a slight overtravel of the shuttle bar 22 past the advanced position and then releases the shuttle bar 22 for a slight returning movement under the urging of return spring 250. At this point, the side surface 400 of the cam wedge 210 engages the side surface 402 of the opening 204 to thus accurately locate the shuttle bar 22 in the advanced position. Thus, as the upper platen assembly 16 moves into the operation segement of the press cycle, the shell casings are precisely located by the position of the shuttle bar 22.

Figure 6B:
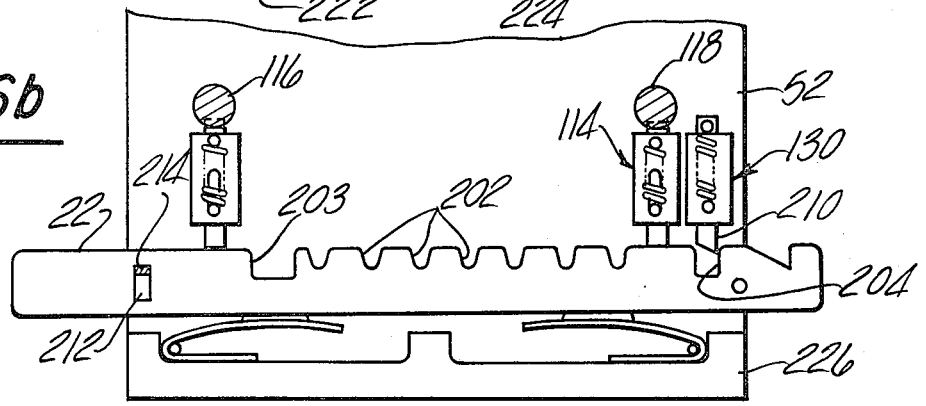

As the upper platen assembly 16 continues to descend past this point, the wedge cams 116 and 118 come into engagement with the wedge surfaces 122 and 124 of the slide bars 126 and 128, respectively, forcing them outwardly towards the front of the loader 10 as indicated in FIG. 6B.

This forces the shuttle bar 22 out laterally against the bias of the spring wire forms 222 and 224, also causing the wedge dog 210 to be withdrawn from the notch 204 of the shuttle bar 22.

Figure 6C:
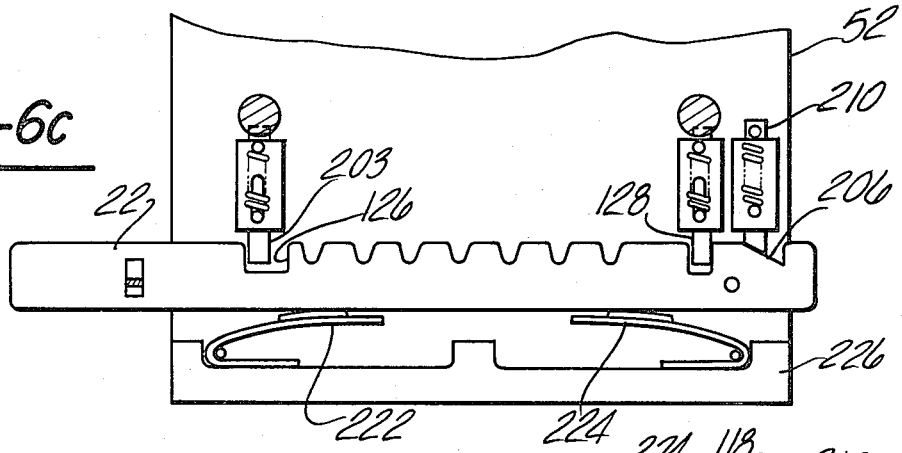
Figure 6D:
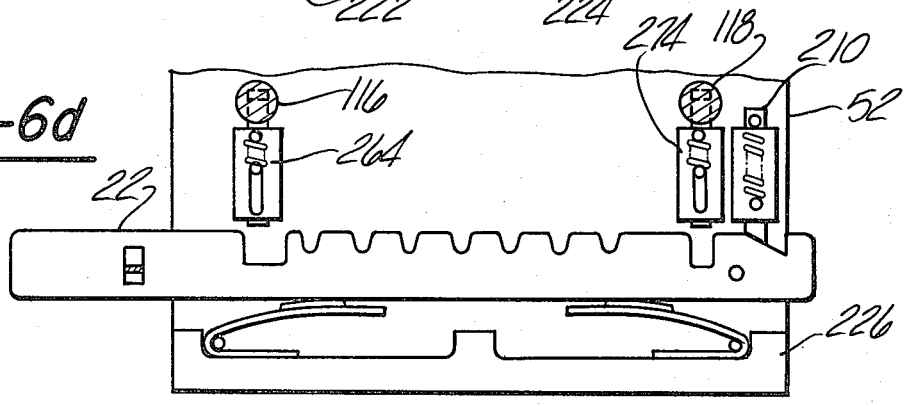

After the wedge dog 210 is completely withdrawn from the shuttle bar, the return spring 250 is allowed to exert its influence on the shuttle bar 22, causing return motion of the shuttle bar 22 to be the initial retracted position shown in FIG. 6C. The leading portions of the pusher bar 126 and 128 reach registry with the notches 203 and 204 enabling the spring wire forms 222 and 224 to assert themselves and force the shuttle bar 22 to the in position depicted in FIG. 6C.

The cam wedge 210 is then positioned into the notch 206 with the inclined forward surface in engagement with the inclined side surface of the notch 206 depicted in FIG. 6C. Upon return movement, the cam wedges 116 and 118 are withdrawn enabling the pusher bars 126 and 128 to be returned to the retracted positions by the springs 264 and 274, respectively.

Thus, the shuttle bar operating mechanism is ready for another cycle since the advancing movement 220 of the shuttle bar 22 causes camming withdrawl of the wedge dog 210, again moving into registry with the notch 204 in the advanced located position.

The wire forms 222 and 224 provide a low cost means for creating an inward biasing force on the shuttle bar 22 maintained throughout its return motion such as to enable the inward motion of the shuttle bar 22 to occur.

The cam contour 106 is configured such as to control return movement of the shuttle bar as depicted in FIGS. 6B and 6C. That is, the return spring 250 is allowed to be gently asserted by the cam contour 106.

Figure 7A:
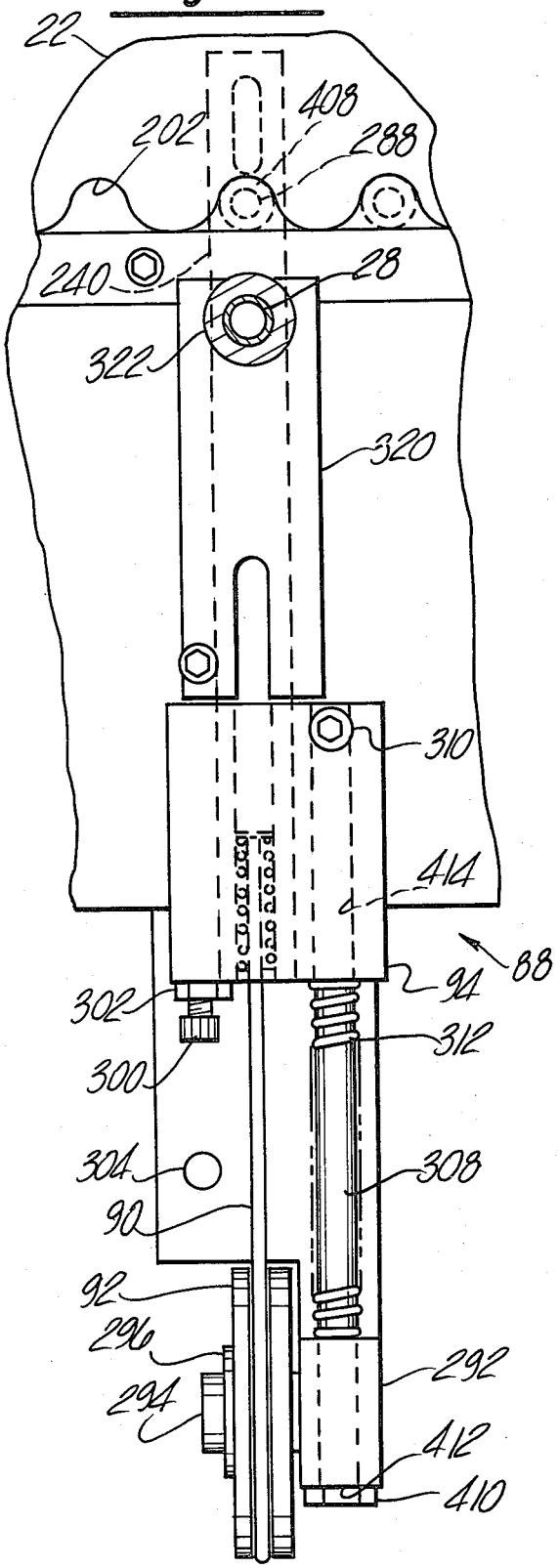
FIG. 7A and 7B are plan views of the primer feed slide mechanism incorporated in the ammunition loader of FIGS. 1 and 2 in the advanced and retracted positions of the primer slide.
Figure 7B:
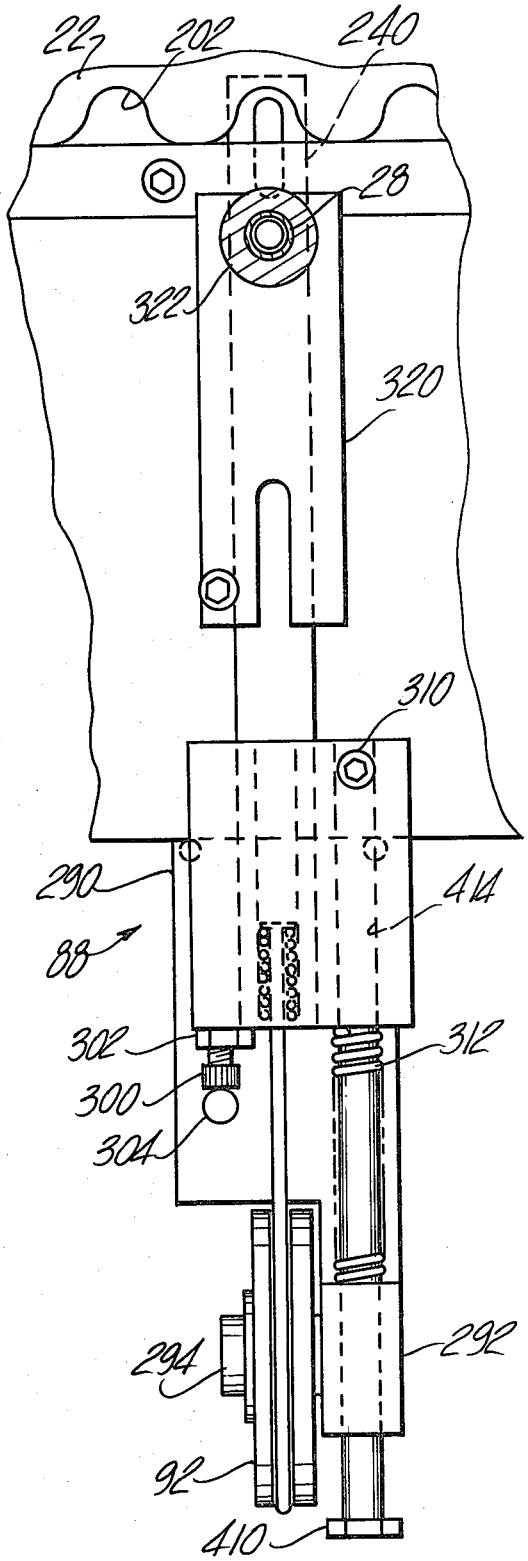
Figure 8:
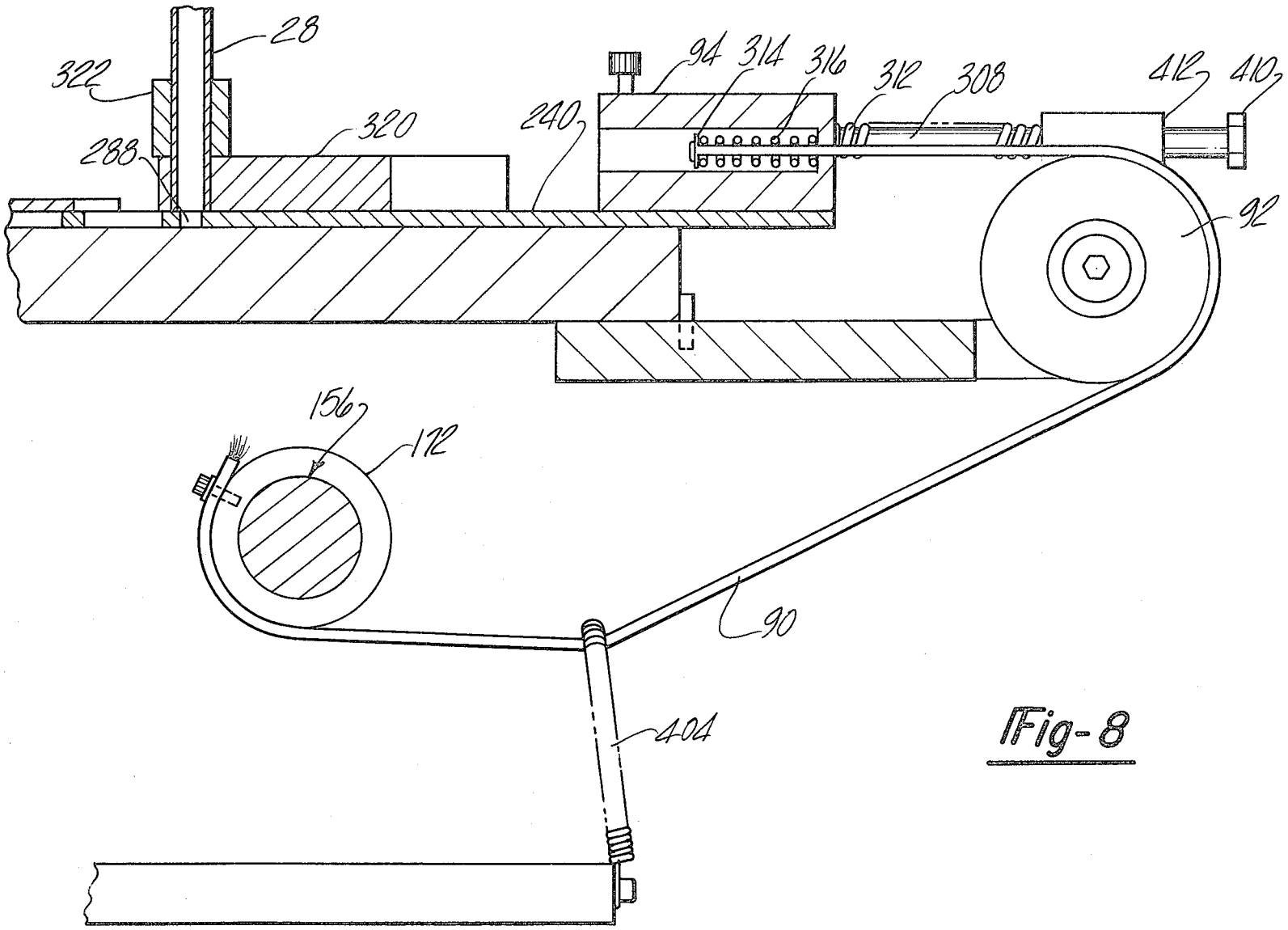
FIG. 8 is a partially sectional view of the primer feed mechanism depicted in FIGS. 7A and 7B.

Reference is now made to FIGS. 7A and 7B, as well as FIG. 8, wherein the details of the primer feed mechanism are depicted since this mechanism forms an important aspect of the ammunition loader according to the present invention.

The operating spring 312 reacts against the primer roller block 292 which is relatively fixed by being mounted to the primer bracket 290, creating an urging or bias force tending to force the primer slide block 94 and primer slide bar 240 to the advanced position whereat the pocket 28 is in alignment with the cartridge case 408. The cable 90 as it is unwound in the grooved collar 172 constitutes a means for releasably allowing the bias means to act to force the primer slide block 94 into the advanced position.

The precise location of the primer slide bar 240 in the advanced position is controlled by the seating of the bolt head 410 onto the surface 412 of the primer roller block which position is adjustable by virtue of the threaded adjustment of the bolt 308 within a threaded bore 414 in the primer slide block 94. The set screw 310 provides a securement of the bolt 308 in any given adjusted position with a nylon insert (not shown) being employed to engage the external threads of the bolt 308.

This thus constitutes positive stop means for limiting the forward movement of the slide block 94 and slide 240 under the urging of the operating spring 312 as releasably controlled by movement of the cable 90 as the cable is unwound off grooved collar 172, in turn induced by rotation downward of the handle assembly 54 and corresponding rotation of the crank assembly 156 in the direction tending to cause the upper platen assembly 16 to descend.

Tensioner spring 404 extends about the cable 90 and secured at 416 to the base plate 132 in order to insure tension on the cable 90 positioned to preclude its jumping off either the wind up roller 172 or the idler roller 92.

The slide block 94 and slide 240 are caused to be moved to a second position or retracted, pick up position whereat the pocket 288 is in alignment with the primer supply tube 28 by wind up of the cable 90, which pulls the slider block 94 to the right as viewed in FIG. 8 or downwardly as viewed in FIG. 7A and 7B against the force of the operating spring 312. This movement continues in the retracting direction until the stop bolt 300 contacts the dowel 304 which provides a positive stop means for locating the slide block 94 and slide bar 240 in the retracted or pick up position. Continued rotation of the crank assembly 156 is accommodated by a lost motion connection between the cable 90 and the slide block 94 afforded by compression spring 316 compressed by means of a washer 314 affixed to the opposite end of the cable 90 from the wind up wheel 172, thus allowing continuing movement of the cable 90 without affecting the position of the slide block 94 in the retracted or pick up position.

Thus, it can be appreciated that the in and out or pick up and advanced positions are adjustable to provide reliable pick up of the supply tube 28 and precise positioning of the primer pocket 288 with respect to the work station. The wear plates 218 and 220 afford the adjustment in the side to side position of the slide 240 such that the position of the pocket 288 may be precisely located in the primer seating station.

It can be seen that the use of cable drive release means allows the operating spring 312 to force the block 94 to the left or advanced work station position inherently allows a dwell or lost motion connection in the forward position inasmuch as the cable 90 is merely slackened, which slack is taken up by the tensioner spring 404. Other linkages could be employed for this purpose to allow a lost motion connection between the slide block and the drive means in both the advanced and retracted positions enabling the use of the adjustable positive stop means in both positions.

A further advantage of the use of the cable drive 90 is in its ease whereby the driving connection between the crank assembly 56 and the slide block 94 is discontinued by merely unlooping the cable 90 from the idler pulley 92. This is of considerable significance in the clearing of a jammed condition since by so disconnecting the drive, the upper platen assembly 16 may be elevated without a driving interlock with the primer slide 240 such that the die sets may be cleared away and the upper platen moved to a position whereat the primer pocket is exposed and enables ready clearance of the pocket unhindered by the presence of the die set in the lower position of the upper platen 16.

In addition, the manner of inducing motion of the slide block, i.e., under the influence of operating springs and with a lost motion spring connection in the retracting motion allows the limitation of the jamming forces applied during manipulation of the press since these springs provide a certain amount of give in the drive.

Accordingly, it can be seen that the ammunition loader according to the present invention admirably fulfills the aboverecited objects of the present invention in that a greatly simplified shuttle bar drive mechanism has been afforded incorporating simplified components while operating extremely reliably and being of rugged construction as are simple in design such as to reduce the cost of manufacture of the apparatus at a minimum, consistent with the overall high quality of the apparatus, this is afforded by the simplified hitch index mechanism operated directly by the platen movement and with the wire form springs being a simplified but reliable means for creating a bias force on the shuttle bar throughout its movement.

The overall arrangement of the components enables operation simply by the descending motion of the upper platen 16, and with all of the components being positioned above the lower platen 14, with the exception of the primer seating components.

The primer feed mechanism itself offers an adjustability in both the foward and retracted positions by relatively simple and uncostly components while allowing precision control over the position so as to enable reliable pick up as well as highly accurate positioning of the primer with respect to the primer seating work station location.

The enablement of the disconnected drive renders the clearing of the jammed conditions following the primer feed slider much less troublesome and yet without entailing complex costly components.

I claim:

1. A press type ammunition loader for performing successive loading steps on shell casings to produce loaded cartridges therefrom, said loader including:

an upper platen assembly and a lower platen assembly and means mounting said upper platen assembly over said lower platen assembly for guided up and down movement with respect thereto;

drive means for causing cyclical movement of said upper platen assembly relative to said lower platen assembly to cause a movement of said upper platen assembly towards said lower platen assembly and back to an elevated position with respect thereto;

a linear array of work stations extending across said lower platen assembly;

a corresponding number of loading process components carried by said upper platen assembly at points thereof in vertical alignment with said work station locations on said lower platen assembly;

an elongated shuttle bar slidably mounted on said lower platen assembly for movement relative to said linear array of work stations, said shuttle bar having a series of casing engaging notches formed along one edge thereof adjacent said linear array of work stations;

means for operating said shuttle bar to undergo advancing movement in a position in engagement with shell casings disposed in said work stations to advance each of said shell casings from preceding station to the next station in said array of work stations and thence to be moved outwardly out of engagement with said shell casings and thence to a return position retracted one station a distance corresponding to the distance between stations and thence inwardly into engagement into said shell casings;

means being operated in response to said relative movement of said lower and upper platen assemblies to produce said movement of said shuttle bar with each cycle of descending and ascending movement of said upper platen assembly with said lower platen assembly.

2. The ammunition loader according to Claim 1 wherein said means for operating said shuttle bar includes a hitch index mechanism consisting of a pivotally mounted hitch index channel secured to said lower platen assembly and a cam follower means mounted to said upper platen assembly said cam follower means including a cam roller and said hitch index channel is formed with a cam contour extending along the line of relative motion of said lower and upper platen assemblies and further including means including a finger portion of said hitch index channel extending into an opening formed in said shuttle bar and a portion of said shuttle bar adjacent said hitch index mechanism and further including a return spring means urging said hitch index channel to a position about said pivotal mounting corresponding to return motion of said shuttle bar, said cam contour being shaped to produce a foward motion of said shuttle bar upon initial descending movement of said upper platen assembly toward said lower platen assembly to said advanced position.

3. The ammunition loader according to claim 2 wherein said cam contour is shaped to release said shuttle bar upon continued descending movement of said upper platen assembly to a position corresponding to the position whereat said operating components operatively engage said shell casings in said stations to perform said loading steps and further including a wedge dog means restraining said shuttle bar from return motion under the urging of said return spring until said shuttle bar has been moved outwardly out of engagement with said shell casings in said work stations.

4. The ammunition loader according to claim 3 wherein said means operating said shuttle bar further includes a pair of spaced pusher bar assemblies, each including a pusher bar and means causing said pusher bars to said one edge of said shuttle bar upon said continued downward descending motion of said upper platen assembly in said cycle and further including spring bias means resisting said outward movement of said shuttle bar wherein said spring bias means includes a pair of C-curved spring forms having portions thereof engaging the other edge of said shuttle bar in engagement therewith during said return sliding movement of said shuttle bar under the influence of said return spring means.

5. The ammunition loader according to claim 1 wherein said means for cyclically operating said ammunition loader and relatively moving said upper platen assembly to descend toward said lower platen assembly and thence to a return elevated position includes a crank assembly rotatably mounted beneath said lower platen assembly and further including a pair of crank throws carried by said spaced crank assembly and also including a pair of links each pivotally mounted to a crank throw and extending upward to said lower platen assembly through said elongated slots formed therein and further including means pivotally connecting the other end of each of said links to said upper platen assembly.

6. The ammunition loader according to claim 5 wherein said operating components include a powder supply tube and a bullet supply tube positioned in alignment with work stations whereat powder is loaded into said shell casings and said bullets are seated in said shell casings, and further including a powder slide mechanism receiving a powder charge from said powder supply tube and moving said powder charge to a position over said shell casing in said corresponding work station and further including a bullet slide mechanism receiving bullets from said bullet supply tube and moving the same over said corresponding bullet seating work station, wherein both of said powder slide mechanism and said bullet slide mechanism, respectively, are operated by cam means operated by said relative movement of said upper platen assembly and said lower platen assembly, said cam means including upstanding corresponding respective cam plates mounted on said lower platen assembly and having cam surfaces extending along the direction of said relative motion of said upper platen assembly and said lower platen assembly, further including said slide mechanism carried by said upper platen assembly and means producing corresponding in and out movement of said slide mechanisms by said operating movement of said upper platen assembly toward said lower platen assembly.

7. The ammunition loader according to claim 6 wherein said operating components further include a primer feed slide mechanism and a primer supply tube, said primer feed slide mechanism further including a primer feed slide bar having a pocket formed therein said mechanism further including means positioning said primer feed slide bar in a first advanced position said primer feed slide bar in a first advanced position with said pockets aligned with a work station corresponding to a primer seating operation and a second pick up position whereat said primer pocket formed in said primer feed slide bar is disposed beneath said primer supply tube, wherein said primer feed slide mechanism includes means for positioning said primer feed slide bar in said advanced and pick up positions in response to oscillation of said crank throw assembly.

8. The ammunition loader according to claim 7 wherein said primer feed slide mechanism includes operating spring means creating a spring force acting to urge said primer feed slide bar into said advanced position and wherein said means operating said primer feed slide mechanism by rotating of said crank assembly includes means withdrawing said slide bar means against the resistance of said operating spring means during said movement to said pick up position, and further including means releasing said slide bar feed primer to be urged into said advanced position by said operating spring means upon corresponding motion of said crank assembly.

9. The ammunition loader according to claim 8 wherein said means releasing said primer feed slide bar includes a drive element moved in correspondence with said rotation of said crank assembly and means drivingly interconnecting said drive element and said primer feed slide bar.

10. The ammunition loader according to claim 9 wherein said means positioning said primer feed slide bar in said advanced and pick up positions further includes adjustable stop means positively limiting said motion of said slide bar in said advanced and retracting motion whereby said advanced and pick up positions are determined by said adjustable stop means.

11. The ammunition loader according to claim 10 wherein said primer feed slide mechanism includes means allowing lost motion between the corresponding motion of said crank assembly and motions corresponding both to said advancing and retracting movement of said primer feed slide bar, whereby said primer feed slide bar may be advanced into said respective fixed stops in said advanced and pick up positions while enabling continued movement of said crank assembly in either of said directions.

12. The ammunition loader according to claim 11 wherein said drive element consists of a flexible cable element and means winding up said cable element in response to rotation of said crank assembly.

13. The ammunition loader according to claim 12 wherein said means connection said flexible cable element and said primer feed slide bar includes a spring compressed by movement of said flexible cable element tending to produce said retracting motion thereof, whereby said lost motion is provided by compression of said compression spring.

14. The ammunition loader according to claim 13 wherein said primer feed slide mechanism further includes an idler pulley and wherein said flexible cable element is passed around said idler pulley, whereby said drive connection may be between said crank assembly and said primer feed slide and may be discontinued by loosening said flexible cable element and removing the same from said idler pulley, whereby limited rotation of said crank assembly does not produce corresponding retraction motion of said primer feed slide bar.

15. An ammunition loader press apparatus for performing successive loading steps on shell casings to produce loaded cartridges therefrom, said loader including:

an upper platen assembly and a lower platen assembly and means mounting said upper platen assembly over said lower platen assembly for guided up and down movement with respect thereto;

drive means for causing cyclical movement of said upper platen assembly relative to said lower platen assembly to cause a movement of said upper platen assembly towards said lower platen assembly and back to an elevated position with respect thereto;

a linear array of work stations extending across said lower platen assembly;

a corresponding number of loading process components carried by said upper platen assembly at points thereof in vertical alignment with said work station locations on said lower platen assembly;

a shuttle bar slidably mounted on said lower platen assembly for movement parallel to said linear array of work stations, said shuttle bar having a series of casing engaging notches formed along one side thereof adjacent said linear array of work stations;

means for operating said shuttle bar to undergo advancing movement in a position in engagement with shell casings disposed in said work stations to advance each of said shell casings from a preceding station to the next station in said array of work stations and thence to be moved outwardly out of engagement with said shell casings and thence to a return position retracted one station a distance corresponding to the distance between stations and thence inwardly into engagement into said shell casings, said shuttle bar operating means includes spring bias means resisting said outward movement of said shuttle bar and exerting an inward bias force thereon until said shuttle bar has returned to the return position, wherein said operating means also includes means enabling said shuttle bar to move inwardly at said return position, the improvement comprising:

spring bias means comprising a pair of spring wire C-forms each having a portion thereof in engagement with said shuttle bar at the edge opposite said one edge of said shuttle bar.

16. In an ammunition loader having means for performing loading steps in ammunition casings, said means including primer seating means and a primer feed supply of primer contained within said tube, said tube being located in a spaced position from a work station whereat said primer seating operation is carried out, the improvement comprising:

primer feed slide means, including a primer feed slide bar formed with a receiving pocket formed therein adapted to receive a primer for positioning with respect to the primer pocket in shell casings disposed in said work station;

a primer feed slide mechanism including means for positioning said primer feed slide bar in said advanced and pick up positions respectively, said means including operating spring means urging said primer feed slide bar toward said advanced position, with said drive means including a drive element drivingly connected to said primer feed slide bar in a first direction of movement of said drive element allowing said operating spring means to advance said primer feed slide bar toward said advanced position and in a second direction moving said primer feed slide bar toward said pick up position and further including a pair of adjustable stop means positively limiting said extent of movement of said primer feed slide bar in said advanced position and said pick up position, locating said primer feed slide bar pocket in said work station position and said pick up position, said means allowing lost motion between said drive element and said primer feed slide bar in either direction after said primer feed slide bar has moved into engagement with either of said stops in said advanced position and in said pick up position, respectively;

whereby said primer feed slide bar is located in said positions by one of said adjustable stop means and rather than directly by said motion of said drive element.

17. The ammunition loader according to claim 16 wherein said means drivingly connecting said drive element and said primer feed slide bar includes a spring means, interposed with said drive element and said driving connection with said primer feed slide bar whereby said drive element compresses said spring means after said engagement with said stop means, whereby said lost motion connection is provided by compression spring while transmitting motion of said drive element.

18. The ammunition loader according to claim 17 wherein said drive element consists of a flexible cable and means for pulling said flexible cable and releasing said flexible cable, whereby said advancing movement of said feed primer slide bar is accommodated by releasing movement of said flexible cable under the influence of said operator spring means and whereby pulling of said flexible cable advances said primer feed slide bar against said operator spring means force towards said retracted pick up position, whereby said advancing movement of said flexible cable after engagement with said adjustable stop means allows lost motion therebetween due to flexing of said cable.

19. The ammunition loader according to claim 18 wherein said feed slide mechanism includes a feed slider block fixed to said primer feed slide bar and wherein said operator spring means includes a compression spring and a fixed block and further includes a bolt member passing through said fixed block and secured to said primer slide block with said compression spring interposed between said fixed block and said primer slide block to create said urging force on said primer slide feed bar, and further including a stop fixed with respect to said bolt engaging said fixed block after a predetermined extent of forward movement of said primer feed slide bar towards said advanced position, whereby one of said adjustable stop means is provided.

20. The ammunition loader according to claim 19 wherein said flexible cable element passes into a bore formed in said primer slide block and wherein said compression spring is disposed in said bore and said flexible cable are adapted to extend oppositely to said direction of advancing motion in order to restrain said motion from said advanced position, said compression spring means transmitting motion of said flexible cable element into said primer slide block, whereby said compression of said compression spring means provides said lost motion after a predetermined extent of motion of said primer feed slide bar toward engagement with said adjustable stop means.

21. The ammunition loader according to claim 18 wherein said means for positioning said flexible cable element includes an idler pulley and wherein said flexible cable is passed around said idler pulley, whereby release of said cable from said idler pulley creates a slack in said flexible cable thus continuing the driving movement of said flexible cable in the degree afforded by said extent of slack.

22. The ammunition loader according to claim 21 wherein said drive means further includes a tension means creating tension in said flexible cable throughout movement of said flexible cable corresponding to said movement of said primer slide block between said adjustble fixed stops.

23. A slide mechanism, including a slide bar and means for positioning said slide bar in advanced and retracted positions respectively, said means including operating spring means urging said slide bar toward said advanced position, with said drive means including a drive element drivingly connected to said slide bar in a first direction of movement in a first direction of movement of said drive element allowing said operating spring means to advance said slide bar toward said advanced position and in a second direction moving said slide bar toward said pick up position and further including a pair of adjustable stop means positively limiting said extent of movement of said slide bar in said advanced position and said retracted position, locating said slide bar pocket in said advanced position and said pick up position, said drive means allowing lost motion between said drive element and said slide bar in either direction after said slide bar has moved into engagement with either of said stops in said advanced position and in said retracted position, respectively;

whereby said primer feed slide bar is located in said positions by one of said adjustable stop means and rather than directly by said motion of said drive element.

24. The slide mechanism according to claim 16 wherein said means drivingly connecting said drive element and said slide bar includes a spring means interposed with said drive element and said driving connection with said slide bar whereby said drive element compresses said spring means after said engagement with said stop means, whereby said lost motion connection is provided by compression spring while transmitting motion of said drive element.

25. The slide mechanism according to claim 17 wherein said drive element consists of a flexible cable and means for pulling said flexible cable and releasing said flexible cable, whereby said advancing movement of said slide bar is accommodated by releasing movement of said flexible cable under the influence of said operator spring means and whereby pulling of said flexible cable advances said slide bar against said operator spring means force towards said retracted pick up position, whereby said advancing movement of said flexible cable after engagement with said adjustable stop means allows lost motion therebetween due to flexing of said cable.

* * * * *